US006338378B1

(12) United States Patent
Kold

(10) Patent No.: US 6,338,378 B1
(45) Date of Patent: Jan. 15, 2002

(54) WINDOW SCREENING ARRANGEMENT WITH A BRAKING DEVICE

(75) Inventor: Ove Kold, Skjern (DK)

(73) Assignee: VKR Holdings A/S, Soborg (DK)

( * ) Notice: Subject to any disclaimer, the term of this patent is extended or adjusted under 35 U.S.C. 154(b) by 0 days.

(21) Appl. No.: 09/673,464

(22) PCT Filed: Apr. 12, 1999

(86) PCT No.: PCT/DK99/00206

§ 371 Date: Nov. 20, 2000

§ 102(e) Date: Nov. 20, 2000

(87) PCT Pub. No.: WO99/54585

PCT Pub. Date: Oct. 28, 1999

(51) Int. Cl.[7] ..... E06B 9/56
(52) U.S. Cl. ..... 160/279; 160/84.06
(58) Field of Search ..... 160/279, 273.1, 160/265, 322, 84.06

(56) References Cited

U.S. PATENT DOCUMENTS 785,806 A * 3/1905 Hopkins ..... 160/279
800,279 A * 9/1905 Emery ..... 160/279 X
800,280 A * 9/1905 Emery ..... 160/279
4,326,577 A * 4/1982 Tse ..... 160/279 X
4,574,864 A * 3/1986 Tse ..... 160/279 X
4,673,018 A * 6/1987 Judkins ..... 160/84.06
4,733,711 A * 3/1988 Schon ..... 160/279 X
4,753,281 A * 6/1988 Wagner ..... 160/279 X
5,533,559 A * 7/1996 Judkins ..... 160/84.06
5,535,806 A * 7/1996 Kold et al. ..... 160/279 X

* cited by examiner

*Primary Examiner*—David M. Purol
(74) *Attorney, Agent, or Firm*—Venable; John P. Shannon; Chad C. Anderson

(57) ABSTRACT

A braking device for a window screening arrangement includes at least one braking member (11, 12) mounted on the cords (4, 5) of the parallel guidance system. The braking members (11, 12) may be designed as hollow symmetrical bodies having a cylindrical outer shape and engage with the bar (3) at the free end of the free end of the screening body (2) of the screening arrangement.

12 Claims, 1 Drawing Sheet

WINDOW SCREENING ARRANGEMENT WITH A BRAKING DEVICE

BACKGROUND OF THE INVENTION

The present invention relates to a braking device for a window screening arrangement, the screening arrangement being intended for mounting in a window aperture defined between a top member, a bottom member and two side members, and including a body of screening material which in an unscreening position is rolled up, collapsed or pleated at the top member and which in a free end is connected with at least one hollow bar extending substantially in parallel with the top and bottom members between the side members substantially throughout the width of the window aperture. A parallel guidance system includes two cords in reverse mounting, each cord being passed from a first fixture at the top member along one side member, through the hollow bar and along the other side member to a second fixture at the bottom member, and a cord tightening device being provided in connection with at least one fixture, in which the braking device includes at least one braking member for retaining the hollow bar in at least one screening position.

In its simplest form, an arresting device may consist of side rails positioned at the window aperture side members and include a number of downwards facing recesses for engagement with the bar or pins connected therewith.

In order to retain the bar at the free end of a screening arrangement in a position in which the window arresting or braking devices have been contemplated.

However, such a design is not suitable for all fields of usage.

FR patent application No. 2 615 240 and U.S. Pat. No 785,806 represent one category of braking devices, in which the braking force of the braking device is adjusted by tightening the cords of the parallel guidance system. As a consequence of the design, operation of the screening arrangement may be difficult, as the braking force has to be surmounted in order to move the screening arrangement between the top and bottom members of the window aperture. This is particularly the case in roller blinds including a roller bar, the spring-bias of which the braking force has to counteract.

U.S. Pat. No 612,606 represents another category of braking devices in which friction shoes at each end of the bottom bar cooperate with the side members of the aperture in order to retain the bar in the desired position. As the friction shoes are biased by springs placed in the bar, the latter have to be deactivated in order to move the screening arrangement. Although operational comfort is provided once the friction shoes have been retracted from their frictional engagement with the side members, this arrangement is complicated and thus costly and cumbersome to produce and mount.

EP patent No. 0 725 885 discloses a roller blind including a braking device of the above stated kind which alleviates many of the disadvantages of the prior art arrangements. The braking device of this reference includes a friction member mounted in the bottom bar, in which at least one reversing member provides for at total change of the direction of the corresponding cord. Although this arrangement has turned out to work efficiently, it is only comparatively simple, as the threading of the cords has to be carried out properly in order to provide the desired frictional braking force. Furthermore, due to the position of the braking device inside the bottom bar, it is virtually impossible to substitute for a defective braking device or provide new cords in the parallel guidance system without discarding the entire window screening arrangement, or at least the bottom bar.

SUMMARY OF THE INVENTION

On this background, it is the object of the present invention to improve a braking device of the above stated kind, in which the manufacture and mounting of the braking device is less complicated and in which the parts of the window arrangement may easily be exchanged.

For this purpose, a braking device according to the invention is characterized in that the at least one braking member of the braking device is mounted substantially stationarily on at least one of said cords and is intended, in a screening position, to engage with said hollow bar.

By this simple design, the braking device and consequently the entire window screening arrangement is simpler and cheaper to manufacture and mount. Furthermore, the braking device may be provided separately, possibly together with the parallel guidance system. It is thus easy to substitute parts of the screening arrangement and it is possible to mount the braking device subsequently on existing screening arrangements not being provided with such a device. Eventually, an indication of the desired screening position is obtained at the moment of engagement between the braking member or members and the bar, which may be advantageous in order to attract the user's attention when the screening arrangement has reached its bottom position to prevent further downwards movement of the screening arrangement.

In a preferred embodiment, each braking member is designed as a symmetrical body, the axis of symmetry of which is substantially parallel with the corresponding cord. By this embodiment, a safe engagement between the braking device and the bar is secured at all times, independently of the rotation or twisting of the cords.

In a constructionally simple embodiment the braking member or members may be designed as hollow body for accommodation of the cord.

Preferably, the braking device comprises at least one pair of braking members placed opposite each other at substantially the same distance from the top member of the window aperture. By this design, the load on the cord system and the tightening means is symmetrical and an aesthetically attractive arrangement is obtained.

Further features and advantage will appear from the present specification.

In another aspect, the braking device is part of a window screening arrangement.

The invention will now be explained in detail with reference to the schematic drawings, in which

DETAILED DESCRIPTION OF THE INVENTION

Figure 3:
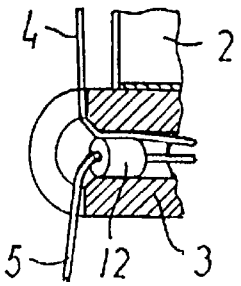
FIGS. 2 and 3 show, on a larger scale, partial sectional view of a detail of the screening arrangement in the beginning and at the end, respectively, of the braking operation.

In the embodiments shown in the Figures of the drawing, the window screening arrangement according to the invention is designed as a roller blind having a body of screening material in the form of a web 2. The web 2 is in one end fastened to and, in the position shown, partially rolled up on a roller bar 1 placed at a top member 10*b* which together with a bottom member 10*b* and two side members 10*c*,10*d* defines a window aperture 10. In the opposite free end, the web 2 is connected with a bottom bar 3 which extends substantially in parallel with the top and bottom members 10*a* and 10*b* between the side members 10*c*, 10*d* substantially throughout the width of the window aperture 10. The parallelism of the bottom bar 3 is secured by a parallel guidance system which includes a pair of cords 4,5 mounted in reverse of each other as will be explained in the following.

The cords 4,5 are in one end fastened to a respective one of a first fixture 7 and 6 situated at the top member 10*a* near or at the side members 10*c* and 10*d*, respectively. From the fixture 7,6, the cords 4,5 are passed along a respective one of the side members 10*c*, 10*d* and through the bottom bar 3, which is formed having a hollowness throughout. During the passage through the bottom bar 3, the cords 4,5 cross each other such that they, on the other side, are passed downwards along the opposite side members 10*d*, 10*c* to a second fixture 8 and 9, respectively. Cord tightening devices 14, 13 are provided in connection with the first fixture devices 7,6. In the embodiment shown, each cord tightening means 14,13 includes a spring connected with each of the fixture means 7,6 but may instead be provided as an elastic cord.

In order to operate the screening arrangement from the initial position, for example, when the web 2 is completely rolled up on the roller bar 1, a pull is exerted on the bar 3 which moves downwards and is, as described in the above, kept in parallel with the top and bottom members 10*a*, 10*b*. In a position, in which the window aperture is at least partially screened, the screening arrangement is arrested or parked in the desired position by a braking device as will be explained in the following. of a braking device as will be explained in the following.

Figure 2:
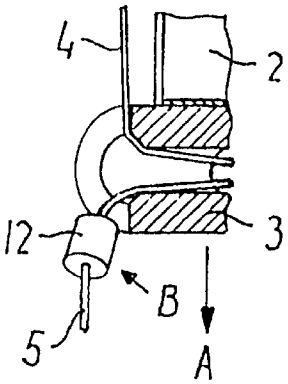

In the embodiment shown, the braking device according to the invention includes two braking members 11,12 mounted on the cords 4 and 5, respectively, opposite each other and substantially at the same distance from the top member 10*a* of the window aperture. As most clearly shown in FIGS. 2 and 3, the braking member 12 is designed as a hollow cylindrical body mounted substantially stationarily on the cord. The outer cross-sectional dimension of the body 12 is one to five, preferably three, times the diameter of the cord 5 and the outer length of the body does not exceed the diameter of the cord multiplied by five, the length being preferably in the interval one to three times the cord diameter.

The outer dimensions of the body ensure that the cord 5, when moving the bar 3 downwards in the direction of the arrow A, is forced outwards in the direction of the arrow B towards the side member 10*c* of the window aperture. During this braking operation, the cord tightening device, in this case the spring, 13, ensures that the cord 5 yields to the load from the body 12. When moving the bar further downwards, the body 12 is brought into engagement with the bar 3 to attain the position shown in FIG. 3 and the cord tightening means 13 pulls the cord 5 back to its normal position. A user operating the screening arrangement has, during the braking operation, experienced a slightly increasing tension of the cord 5 after which the cord is relaxed, thus obtaining the desired indication of the screening position.

Figure 4:
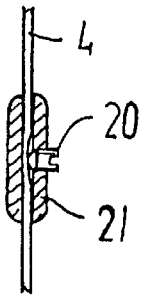
FIG. 4 shows, on a larger scale, a sectional view of another embodiment of the screening arrangement according to the invention, and FIG. 5 a view corresponding to FIG. 4 of a further embodiment of the invention.
Figure 1:
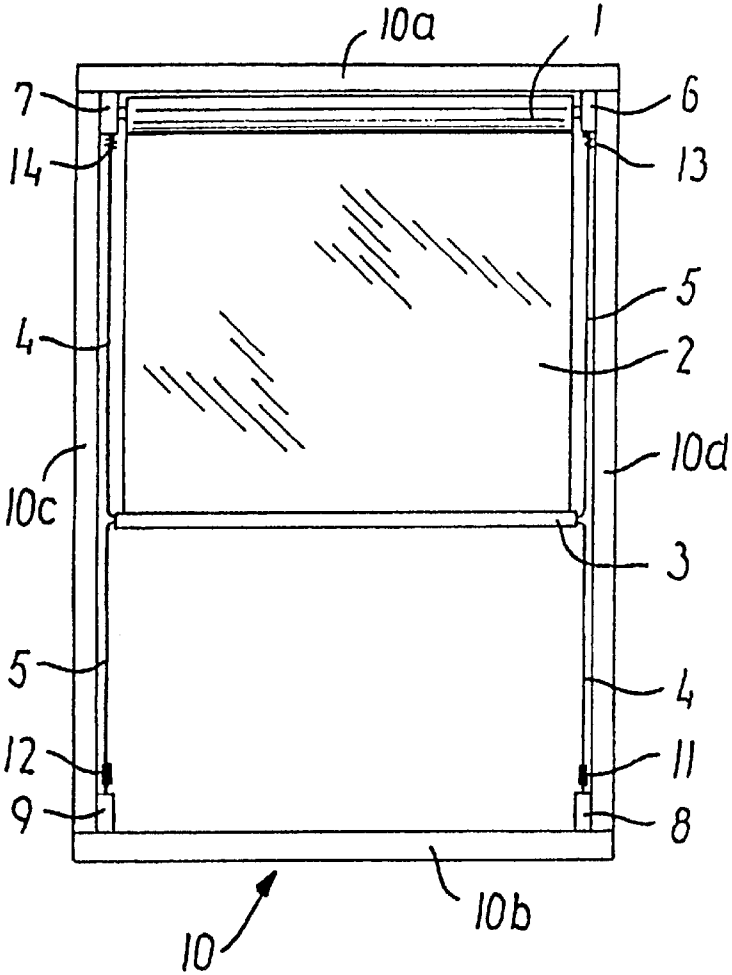
FIG. 1 shows a front view of a window screening arrangement according to the invention.

FIG. 4 shows a detachable connection between the braking member 21 and the cord 4 by means of a screw 20. The connection could as well be performed by a spring-biased catch engaging the cord or in any other way. From this Figure, it further emerges that the body 21 is designed with rounded end portions in order to ease the engagement with the bar 3.

Figure 5:
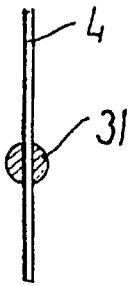

In FIG. 5, an alternative embodiment of the braking member is shown as a spherical body 31. The body 31 is inseparably connected to the cord 4 by moulding, gluing, heatshrinking or in any other way.

The parallel guidance system may, as described in Applicant's international patent application published under No. WO98/32944, be provided in the form of a separate system for mounting on a window screening arrangement and including a hollow mounting bar for connection with the bottom bar profile of strip at the free end of the screening body. It is clear that a braking device according to the invention may advantageously be delivered together with such a system.

Furthermore, an electrically operated driving device may be connected with the bottom or mounting bar of the window screening arrangement.

It is further evident that more than the shown one pair of braking members placed at the same distance from the top member of the window aperture may be provided in order to provide a plurality of screening positions.

Although the window screening arrangement in the above embodiments is described as a roller blind, the invention is not limited to this kind of screening arrangement, and could be a black-out curtain, a pleated blind or a venetian blind. In the case of light-proof screening arrangements having covering elements along the edges of the aperture, the light imperviousness may be obtained by a flap, flange or sealing connected with the bottom or mounting bar.

Eventually, the invention should not be regarded as being to limited to use with any particular kind of window, but may be used in all kinds of apertures or windows in the form of facade windows, roof windows, skylights etc.

What is claimed is:

1. A window screening arrangement for mounting in a window aperture (10) having a width and defined between a top member (10*a*), a bottom member (10*b*) and two side members (10*c*, 10*d*), the window screeening arrangement comprising:

a body (2) of screening material which, in an unscreening position, is one of rolled up, collapsed and pleated at the top member (10*a*) and has at least one free end;

at least one hollow bar (3) extending substantially in parallel with the top and bottom members (10*a*, 10*b*) between the side members (10*c*, 10*d*) substantially throughout the width of the window aperture, said at least one hollow bar being connected with the at least one free end of the body;

a parallel guidance system comprising two cords (4, 5) in reverse mounting, and a first fixture means at the top member and a second fixture means at the bottom member, each cord being passed from the first fixture means (7, 6) at the top member (10*a*) along one of the side members (10*c*, 10*d*), through the hollow bar (3) and along the other of the side members (10*d*, 10*c*) to the second fixture means (8, 9) at the bottom member (10*b*);

a cord tightening means (14, 13) being provided in connection with at least one of the fixture means (7, 6); and a braking device comprising at least one braking member (11, 12; 21; 31) adaptable to retain the hollow bar (3) in at least one screening position, wherein said at least one braking member (11, 12; 21; 31) of the braking device is mounted substantially stationarily on at least one of said cords (4, 5) and, in a screening position, engages said at least one hollow bar (3).

2. The window screening arrangement according to claim 1, wherein said at least one braking member (11, 12; 21; 31) is designed as a symmetrical body having an axis of symmetry substantially parallel with said at least one of said cords (4, 5).

3. The window screening arrangement according to claim 1, wherein each braking member (11, 12) is designed as a hollow body to accommodate said at least one of said cords (4, 5).

4. The window screening arrangement according to claim 3, wherein the body has an outer shape and the outer shape of the body (11, 12; 21) is one of a cylinder and frustum of a cone.

5. The window screening arrangement according to claim 4, wherein the body is designed with rounded end portions.

6. The window screening arrangement according to claim 3 wherein the body (31) has a spherical outer shape.

7. The window screening arrangement according to claim 1, wherein said at least one braking member (21) is detachably connected to said at least one of said cords (4).

8. The window screening arrangement according to claim 7, wherein said at least one braking member (21) is connected to said at least one of said cords (4) by one of a screw (20) and a spring-biased catch.

9. The window screening arrangement according to claim 1, wherein said at least one braking member (31) is inseparably connected to said at least one of said cords (4) by one of moulding and gluing.

10. The window screening arrangement according to claim 1, wherein said at least one said cords has a diameter, and wherein said at least one braking member (11, 12; 21; 31) has an outer cross-sectional dimension in a range of one to five times the diameter of the cord (4, 5) and an outer length which does not exceed the cord diameter multiplied by five.

11. The window screening arrangement according to claim 1, wherein the braking device further comprises at least one pair of braking members (11, 12; 21; 31) placed opposite each other at a substantially same distance from the top member **(10*a*)** of the window aperture.

12. The window screening arrangement according to claim 1, wherein the cord tightening means (14, 13) are dimensioned in such that the cords are held tightly throughout operation of the window screen arrangement.

* * * * *